US011421408B1

(12) United States Patent
Rosario

(10) Patent No.: US 11,421,408 B1
(45) Date of Patent: Aug. 23, 2022

(54) POPUP DRAIN STOPPER WITH DEBRIS TRAP AND POPUP DRAIN STOPPER ASSEMBLY HAVING THE SAME

(71) Applicant: Israel Rosario, Davie, FL (US)

(72) Inventor: Israel Rosario, Davie, FL (US)

( * ) Notice: Subject to any disclaimer, the term of this patent is extended or adjusted under 35 U.S.C. 154(b) by 0 days.

(21) Appl. No.: 17/408,556

(22) Filed: Aug. 23, 2021

Related U.S. Application Data

(60) Provisional application No. 63/258,068, filed on Apr. 12, 2021.

(51) Int. Cl.
*E03C 1/23* (2006.01)
*E03C 1/262* (2006.01)

(52) U.S. Cl.
CPC ..... *E03C 1/2302* (2013.01); *E03C 1/262* (2013.01)

(58) Field of Classification Search
CPC . E03C 1/262; E03C 1/26; E03C 1/264; E03C 2001/2311; E03C 1/2302; E03C 1/2306; E03C 1/23; A47K 1/14
See application file for complete search history.

(56) References Cited

U.S. PATENT DOCUMENTS

| | | | | |
|---|---|---|---|---|
| 5,003,642 | A | 4/1991 | Robb | |
| 6,263,518 | B1 | 7/2001 | Magtanong | |
| 8,327,474 | B2 * | 12/2012 | Van Zeeland | E03C 1/23 4/692 |
| 9,611,631 | B2 * | 4/2017 | Rosko | E03C 1/262 |
| 9,745,728 | B2 * | 8/2017 | Beck | E03C 1/2302 |
| 10,494,800 | B2 * | 12/2019 | Ahuja | E03C 1/2302 |
| 11,066,819 | B2 | 7/2021 | Rosario | |
| 2009/0151060 | A1 | 6/2009 | Zubillaga | |
| 2010/0115689 | A1 | 5/2010 | Thompson | |
| 2014/0007334 | A1 * | 1/2014 | Golibart | E03C 1/262 4/287 |
| 2014/0165275 | A1 | 6/2014 | Zito | |
| 2016/0040412 | A1 | 2/2016 | Fetkovich | |
| 2016/0251839 | A1 | 9/2016 | Ali | |
| 2016/0265204 | A1 | 9/2016 | Zito | |

* cited by examiner

*Primary Examiner* — Janie M Loeppke
(74) *Attorney, Agent, or Firm* — Lewellyn Law, PLLC; Stephen Lewellyn

(57) ABSTRACT

The present disclosure relates to popup drain stopper and popup drain stopper assemblies. The popup drain stopper includes a debris trap having a plurality of bristle arranged to trap debris flowing into a drainpipe in which the stopper is positioned. Popup drain stopper assemblies include the popup drain stopper with the debris trap and the ability to remove the drain stopper from the drainpipe without disassembly.

14 Claims, 9 Drawing Sheets

19
10
20
26
3
3
28
28
16
26
22

18
26
28
20
26
26
18
18
26
30
19
34
36
38
36
34
20
32
18
18
28
16
10

FIG. 16
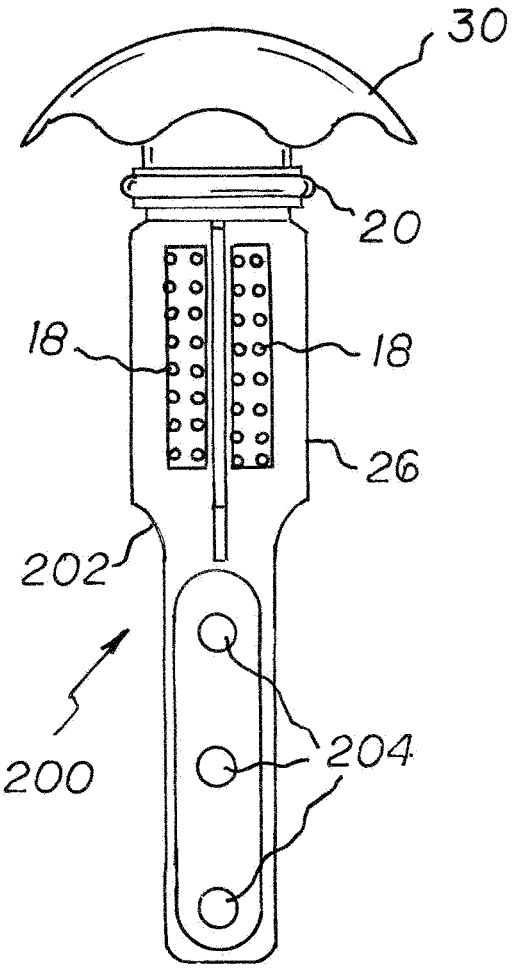
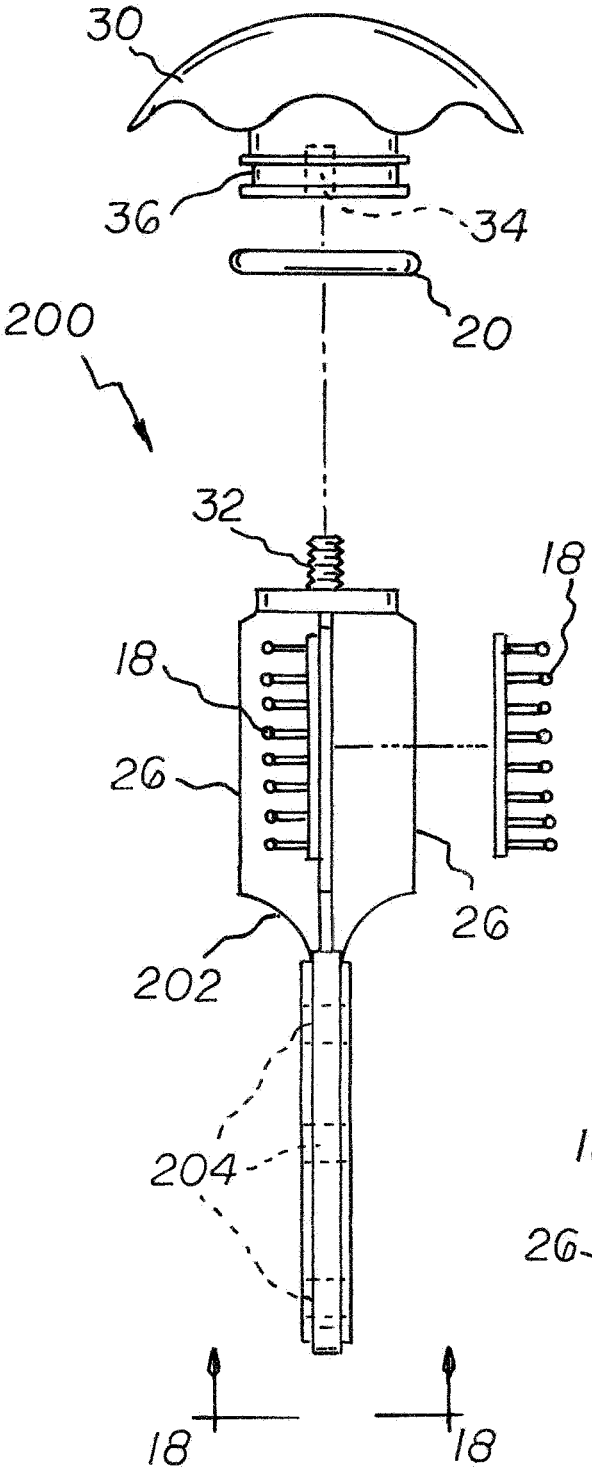
FIG. 17
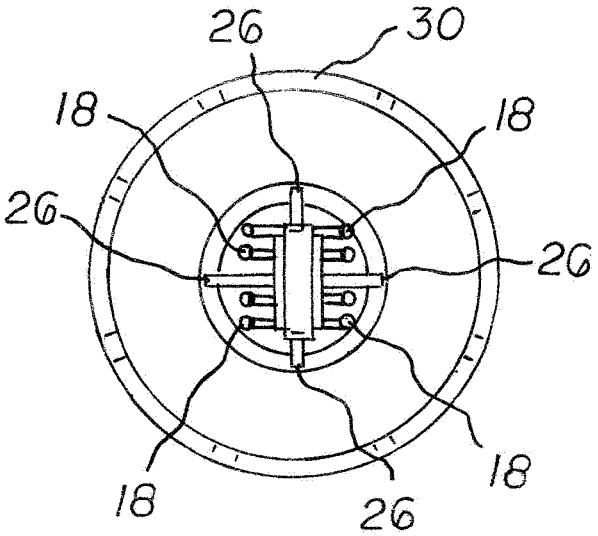
FIG. 18

POPUP DRAIN STOPPER WITH DEBRIS TRAP AND POPUP DRAIN STOPPER ASSEMBLY HAVING THE SAME

CROSS-REFERENCE TO RELATED APPLICATIONS

This application claims priority to U.S. Provisional Application 63/258,068, filed Apr. 12, 2021, and which is hereby incorporated herein by reference in its entirety.

FIELD OF THE INVENTION

The present disclosure relates to popup drain stoppers and, more particularly, to popup drain stoppers with debris traps and popup drain stopper assemblies having the same.

BACKGROUND OF THE INVENTION

Sinks, showers, and bathtubs contain a drainage outlet to permit the egress of water from the reservoir. The drainage outlet may be open or contain a drain protector to act as a sieve by removing debris from the flow of water before its entrance into the drain. Some drainage outlets are equipped with a pop-up plug allowing the user to selectively retain water in the reservoir before drainage.

Even with the use of a drain cover, drainpipes often become clogged due to the buildup of debris washed away by the flow of water. The leading cause of clogging is the accumulation of hair which slowly builds over time until the water no longer drains effectively. The inability of water to drain may result in unsanitary conditions and provides a medium for harboring bacteria and waterborne pathogens.

It can be undesirable to chemical-based drain cleaners due to their toxicity. The most common chemical is highly concentrated sulfuric acid which can dissolve cellulose, proteins, and fats. Such harsh chemicals are potentially dangerous if used improperly, and repeated use often results in damage to the drainpipes, leading to expensive repairs. Further, the chemicals found in drain cleaners may react with household products and cause explosive, or highly toxic reactants.

SUMMARY OF THE INVENTION

Embodiments described herein provide for a drain stopper and drain stopper assembly with a removable debris trap to prevent debris in wastewater from entering a drainpipe without the use of chemicals.

Embodiments described herein provide for a drain stopper assembly having a drain stopper with a debris trap and that is removably connectable to a lever rod of a drain stopper operating mechanism without requiring disassembly of the drain stopper operating mechanism.

Embodiments described herein provide for a drain stopper assembly having a drain stopper with a debris trap and that is selectively positionable and held in position in a drainpipe through magnetic coupling.

Embodiments described herein provide for a debris trap having various debris catching bristle configurations.

In one aspect, a popup drain stopper comprising has a stem configured to be movable vertically within a drainpipe. The stem has a top end, a bottom end, a length extending therebetween, and at least two fins extending along the length. A cap attached to the top end of the stem. And a plurality of bristles are attached to and extending outwardly from at least one fin and are configured to trap debris entering the drainpipe when the stem is disposed in the drainpipe.

In another aspect, a lower length of the stem is bifurcated into a pair of coextending tangs that are separated by a slot that extends from the bottom end of the stem in a direction toward the upper end of the stem. The slot is configured to removably receive a lever rod in a sliding engagement between the tangs in a direction upwardly from the bottom end of the stem. A lower end of each tang has a winglet that extends in opposite directions of one another and provide a fishtail-shaped notch therebetween at the bottom end of the stem. The fish-shaped notch narrows in a direction from the bottom end of the stopper toward the top end of the stopper. The winglets combined with the fishtail-shaped notch guide the lever rod toward the open end of the slot when the lever rod is slid into engagement with the slot.

In another aspect, a popup drain stopper assembly has a stem configured to be movable vertically within a drainpipe. The stem has a top end, a bottom end, a length extending therebetween, and at least two fins extending along the length. A cap is attached to the top end of the stem. A plurality of bristles are attached to and extending outwardly from at least one fin and are configured to trap debris entering the drainpipe when the stem is disposed in the drainpipe. A lower end of the stem has a plurality of stem magnets spaced along a length of the lower end. A retaining magnet is attached to the drainpipe and configured to selectivity retain the stem at a desired position in the drainpipe by a magnetic force between one of the stem magnets and the retaining magnet.

In another aspect, a popup drain stopper assembly has a stem configured to be movable vertically within a drainpipe. The stem has a top end, a bottom end, a length extending therebetween, and at least two fins extending along the length. A cap is attached to the top end of the stem. A plurality of bristles are attached to and extending outwardly from at least one fin and are configured to trap debris entering the drainpipe when the stem is disposed in the drainpipe. A stem magnet is attached to the bottom end of the stem. A lever rod extends into the drainpipe and has an engagement end. A retaining magnet is attached to the engagement end of the lever rod and configured to magnetically and removably couple with the stem magnet to connect the stem to the lever rod.

Numerous additional objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature or a feature with similar functionality. In the drawings:

FIG. 16 is a second side elevation view of the popup drain stopper of FIG. 15;

FIG. 17 is a second side elevation view of the popup drain stopper of FIG. 15, shown partially exploded;

FIG. 18 is a bottom view of the popup drain stopper of FIG. 15;

DETAILED DESCRIPTION

Embodiments of the invention provide a popup drain stopper with debris trap and popup drain assemblies having the same. As used herein, the term "debris" may refer to any object that may be transferred into a drain outlet and the drainpipe. By way of non-limiting example, the debris may include hair, hairpins, soaps and detergents, dust, dirt, cosmetic products, jewelry, or other small particles and objects.

Embodiments relate to a drain stopper configured to be at least partially inserted into a drain outlet. The drain stopper may be configured to be used in any plumbing fixture having a drain outlet including, but not limited to a floor drain, sink, bathtub, shower, lavatory, or similar drains wherein debris may cause a clog resulting in the inability to drain fluids. The drain stopper is comprised of a removable debris trap configured to filter and trap debris from obstructing the flow of water before the debris continues further into the drainpipe.

Figure 1:
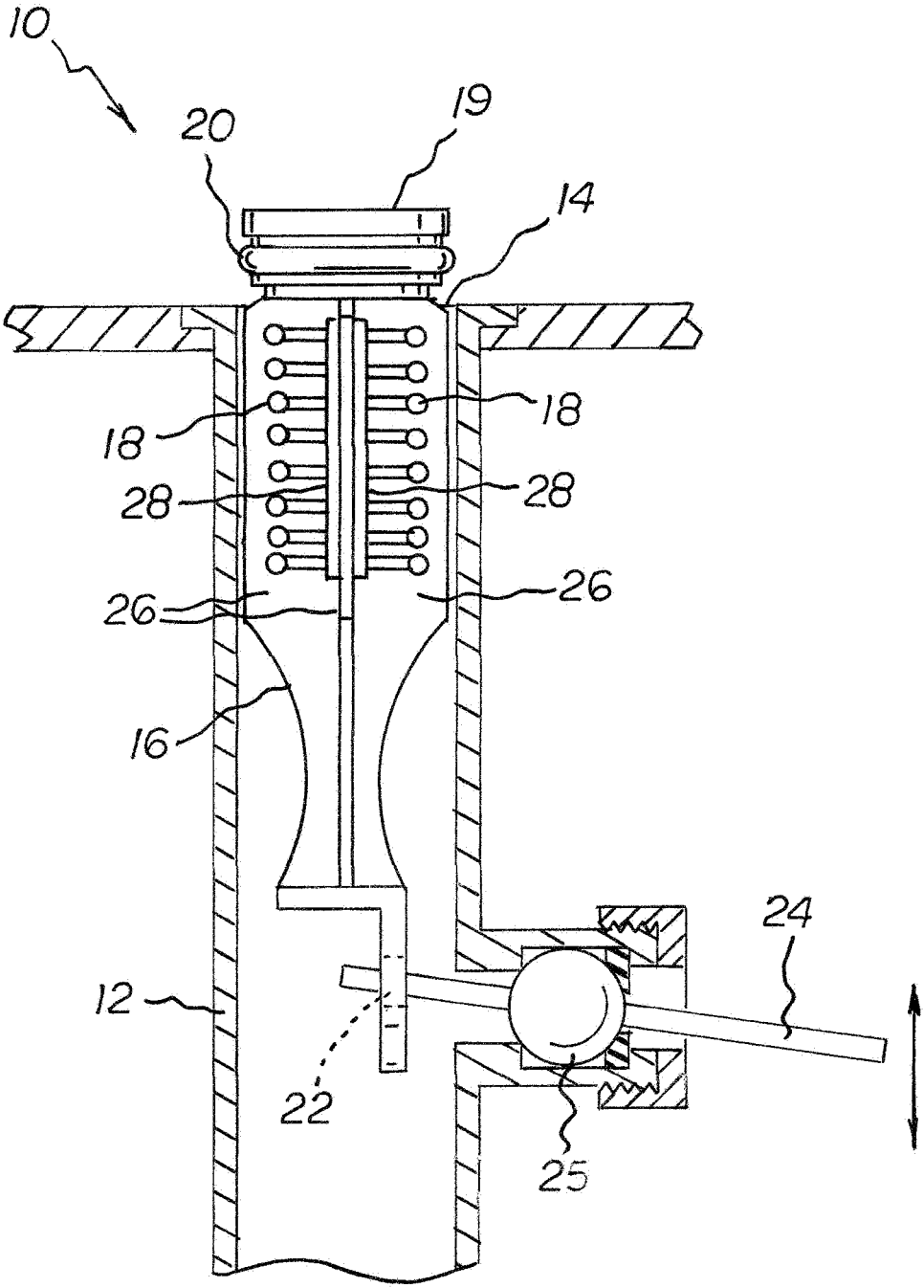
FIG. 1 is a first side elevation view, partially in cross-section, showing a popup drain stopper provided in accordance with an embodiment of the invention in a drainpipe.

In FIG. 1, there is illustrated a popup drain stopper 10 in accordance with an embodiment of the invention. The stopper 10 is shown disposed in the interior of a conventional drainpipe 12 having a drain opening 14 through which the stopper is inserted for up and down movement within the interior of the drainpipe to selectively seal the drain opening.

The stopper 10 has an elongated stem 16 with opposite, upper and lower ends. A cap 19 is attached to the stem at its upper end. The cap 19 has a seal, such as, for example an O-ring 20. The cap 19 and seal 20 extend above the drain opening 14 when raised to an elevated position and closes and seals the drain opening when lowered into a sealing position by the seal making a sealing contact with the drainpipe. In the representatively illustrated embodiment, the lower end of the stem 16 has an aperture 22 which engages with a lever rod 24 of a conventional stopper actuating mechanism that is well known in the art and operates raise and lower the stopper for sealing and opening the draining opening 14. The lever rod 24 is connected to a captive ball 25, which allows the rod to be pivoted upward and downward to move the stopper.

Figures 2, 3, 4:
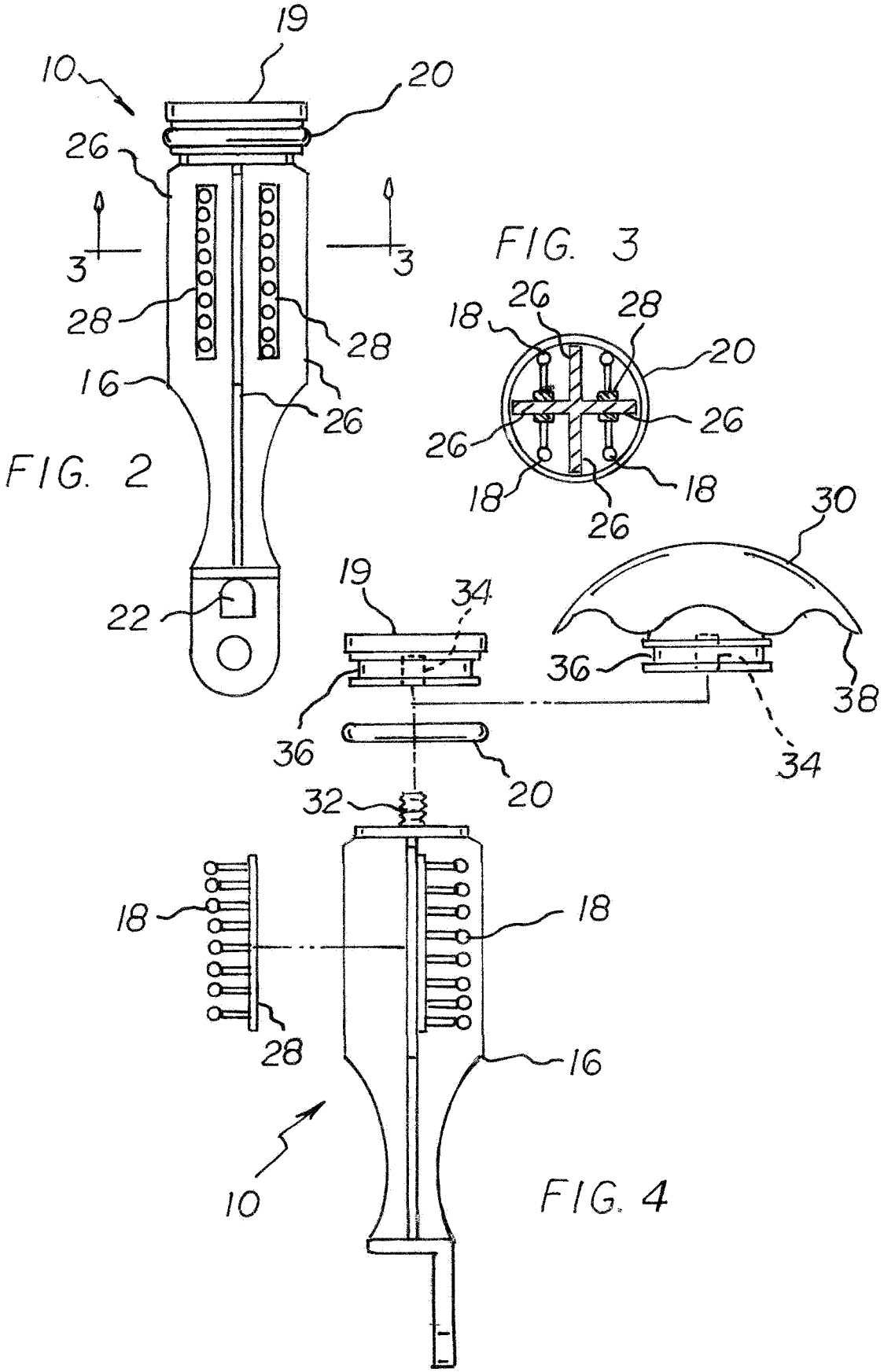
FIG. 2 is a second side elevation view of the popup drain stopper of FIG. 1.
FIG. 3 is a bottom view of the popup drain stopper of FIG. 1.
FIG. 4 is a side elevation view, partially exploded, of the popup drain stopper of FIG. 1.

With continued reference to FIG. 1 and further reference to FIGS. 2 and 3, the stem 16 has four, elongated, perpendicular ribs or fins 26 that extend along the length of the stem between its opposite ends. A row of bristles 28 is disposed along opposite broad surfaces of at least two fins 26 (one only visible in this figure) and extend outwardly therefrom in a direction that is generally perpendicular to the longitudinal length of the stem.

The bristles 28 provide a debris trap for trapping, collecting, or otherwise entangling debris that flows through the drain opening 14 and along the stopper 10. The debris being trapped by the bristles 28 is prevented from flowing through the drainpipe, thereby preventing clogging thereof. The stopper 10 can be removed from the drainpipe for clearing or cleaning the bristles of the debris.

While, in this representative embodiment, only a single row of bristles 28 is shown disposed on opposite surfaces of at least two fins 26, it should be understood the invention is not limited to this arrangement. Any number of rows, shape, size, or configuration of bristles may be disposed on the fins 26 for trapping, collecting, or otherwise entangling debris that flows through the drain opening could be used.

With additional reference to FIG. 4, there is shown an exploded view of stopper 10. The upper end of the stem 16 may have a threaded stud 32 and the lower end of cap 19 may have a corresponding threaded aperture 34 to threadedly attach the cap to the upper end of the stem. The cap 19 may further include a circumferential groove 36 for receiving and retaining the seal 20. As further shown, the upper end of the cap 19 has a generally flat, cylindrical shape.

Figure 5:
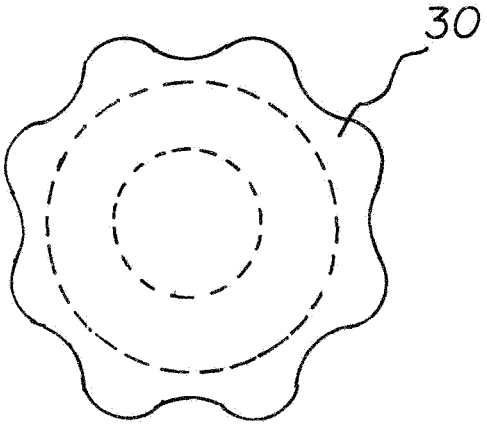
FIG. 5 is a top view of a cap provided in accordance with an embodiment of the invention.

Further shown is an alternative cap 30. Like cap 19, cap 30 includes a threaded aperture 34 for attaching the cap to the threaded stud 32 and includes a circumferential groove 36 for receiving and retaining the seal 20. The upper end of cap 30, however, is dome-shaped and includes a scallop-shaped circumferential edge 38. FIG. 5 illustrates at top-down view of cap 30.

Figure 6:
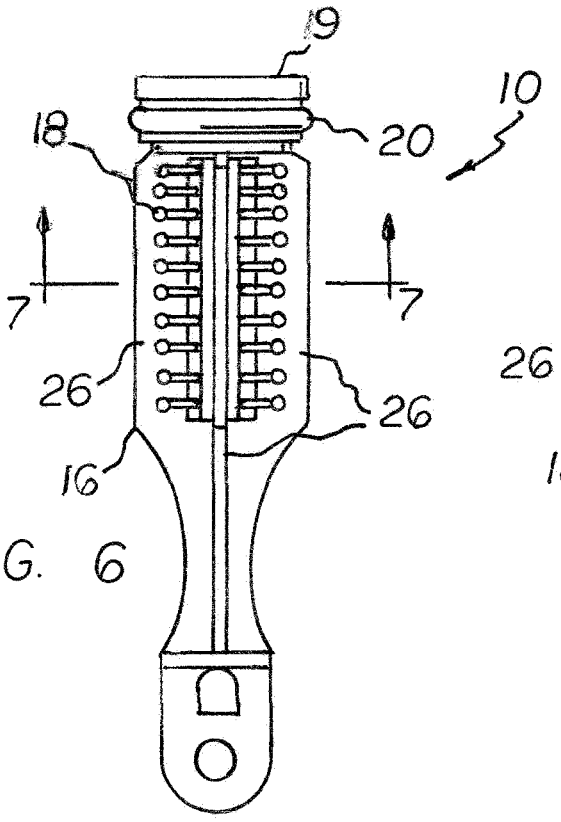
FIG. 6 is a side elevation view of popup drain stopper provided in accordance with an embodiment of the invention.
Figure 7:
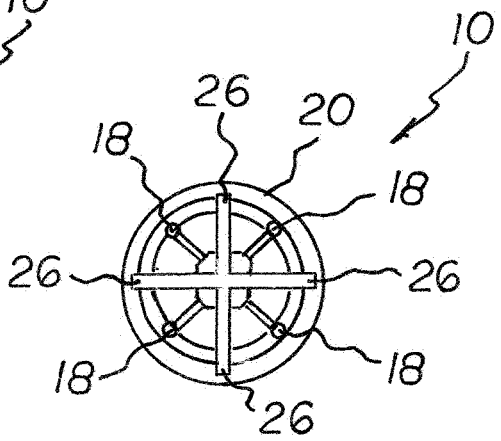
FIG. 7 is a bottom view of the popup drain stopper of FIG. 6.

In FIGS. 6 and 7, stopper 10 is shown with an alternative arrangement of bristles 28 on stem 16. Particularly, bristle rows 28 are disposed in the corners formed between two conjoining fins 26 and extend along the length of the fins and outwardly therefrom at generally 45 degrees relative to the corresponding fins.

Figure 8:
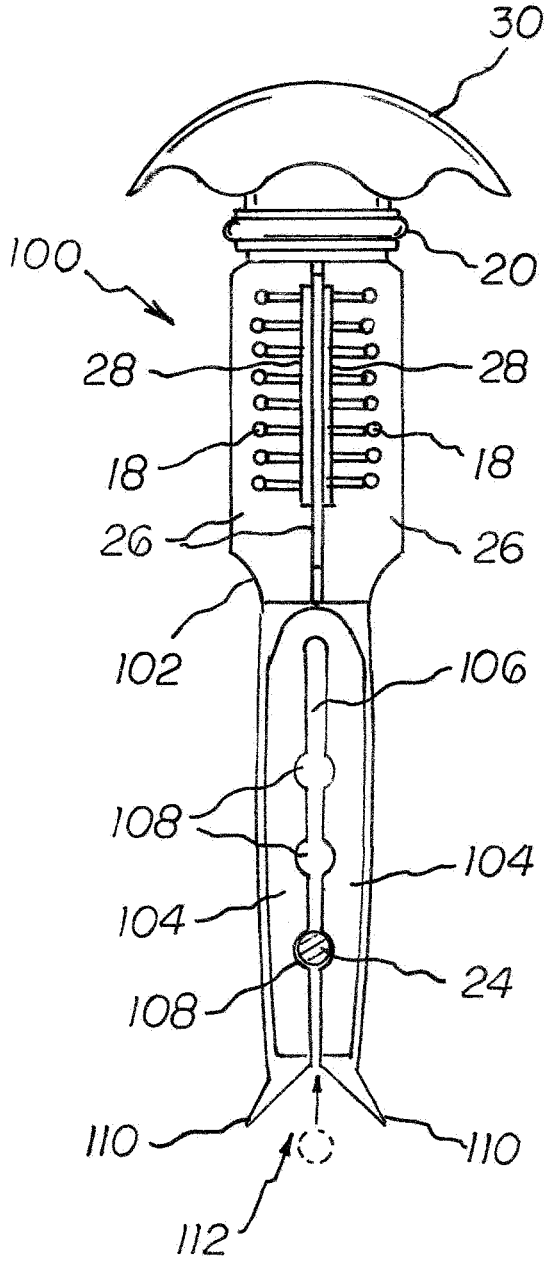
FIG. 8 is a side elevation view of popup drain stopper provided in accordance with an embodiment of the invention.
Figure 9:
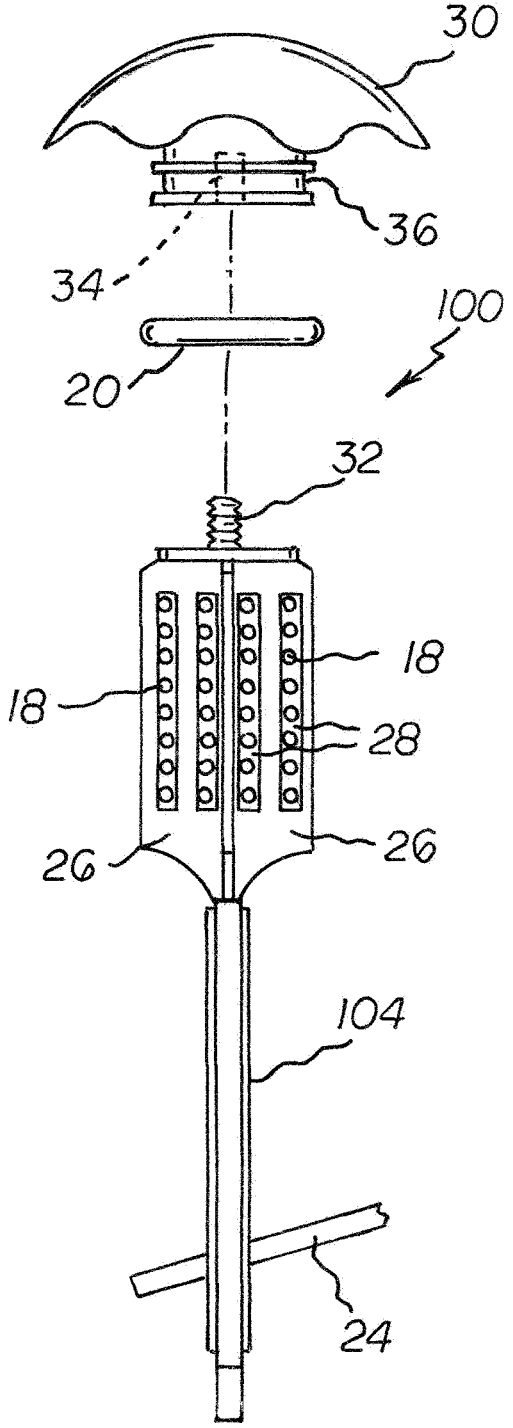
FIG. 9 is a second side elevation view of the popup drain stopper of FIG. 8, shown partially exploded.

In FIGS. 8 and 9 there is illustrated a popup drain stopper 100 in accordance with an embodiment of the invention. Stopper 100 has a construction like stopper 10 and, accordingly, like reference numbers refer to similar elements. Stopper 100 is configured to allow an easier coupling and decoupling with lever rod 24 without requiring a user to dissemble the stopper operating mechanism. Further, stopper 100 is configured to prevent an unknowledgeable user from inadvertently breaking the stopper or the lift mechanism when he or she attempts to forcefully withdraw the stopper from an associated drainpipe.

Particularly, as shown, a lower length of stem 102 of stopper 100 is bifurcated into a pair of coextending tangs 104 that are separated by a slot 106 extending from the lower end of the stem in a direction toward the stem's upper end. The slot 106 is configured to removably receive the lever rod 24 in a sliding engagement between the tangs 104 from the lower end of the stem. The slot 106 may have at least one, representatively shown three, apertures 108 spaced along the length of the slot. The apertures are configured to selectively retain the lever rod 24 at positions along the length of the slot. The width of the slot 106 narrows in a direction from the upper end toward the lower end of the stem 102 to provide a frictional engagement and retention force to the lever rod 24 against withdrawal from the slot once inserted therein.

The lower end of each tang 104 has a winglet 110 that extend in opposite directions of one another and provide a fishtail-shaped notch 112 therebetween at the lower of end of the stem 102. The fish-shaped notch 112 narrows in a direction from the lower end of the stopper toward the top end of the stopper. The winglets 110 combined with the fishtail-shaped notch 112 guide the lever rod 24 toward the open end of the slot 106. The interior surfaces of the winglets 110 contact the exterior surface of the lever rod 24 as the rod is advanced toward the slot opening which causes tangs 104 to flex outwardly from one another and open the narrow end of the slot for reception of the lever rod therein. The winglets 110 extend in the opposite directions by each having an outward surface that extends at an angle from the outward side of its respective tang 104 and terminate at a winglet tip that is disposed at an outward position relative to the outward side of the tang.

Further shown is another arrangement of the bristles 18. Particularly, the opposite surfaces of at least two fins 26 include two bristle rows 28, as opposed to a single row shown and described above.

Figure 10:
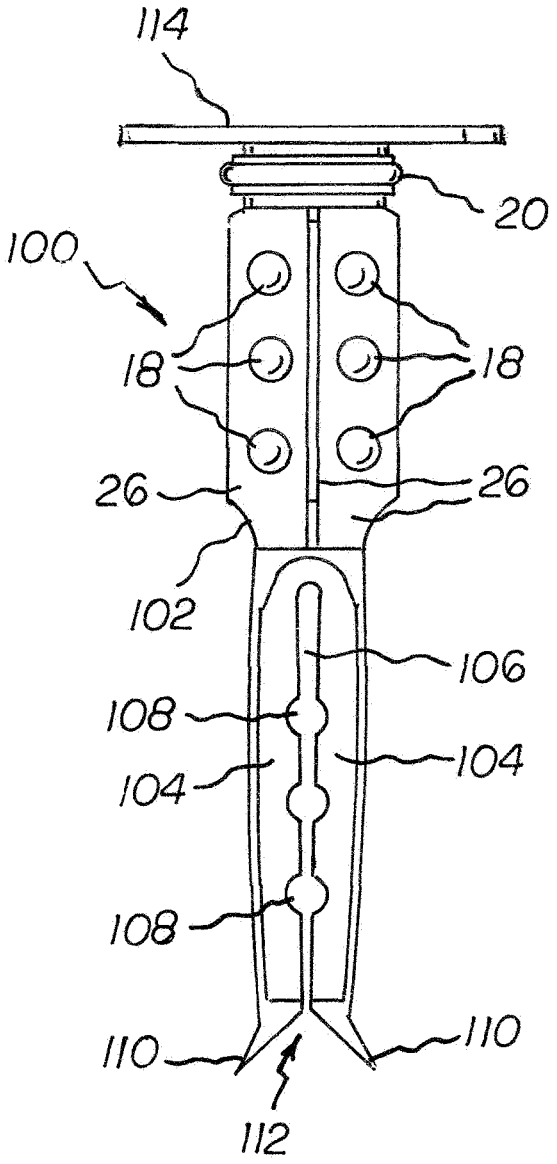
FIG. 10 is a side elevation view of popup drain stopper provided in accordance with an embodiment of the invention.
Figure 11:
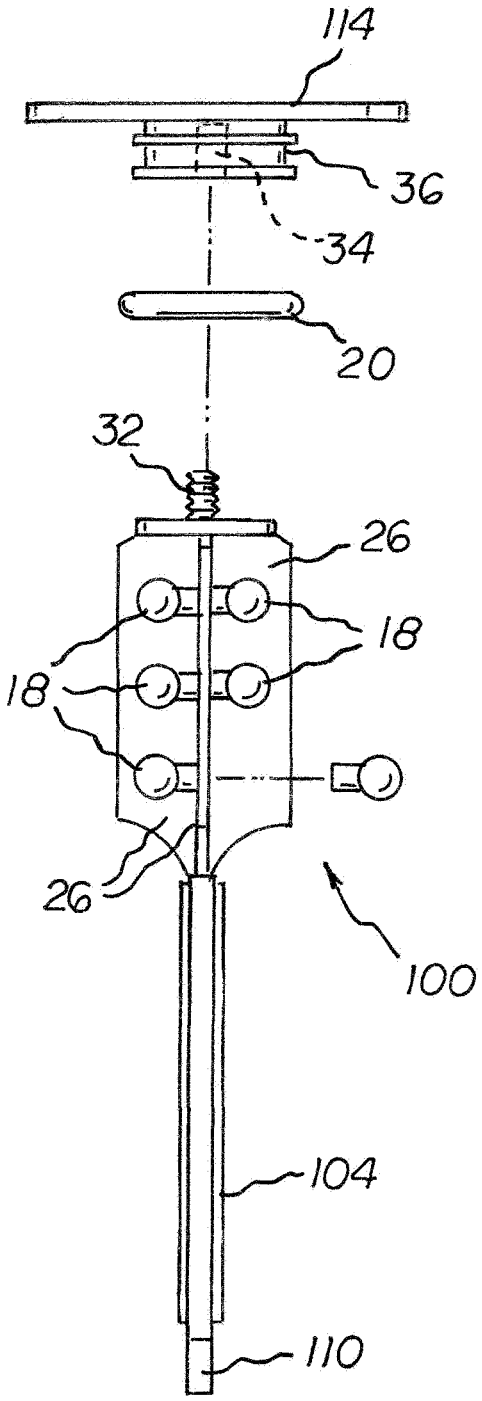
FIG. 11 is a second side elevation view of the popup drain stopper of FIG. 10, shown partially exploded.

FIGS. 10 and 11 illustrate stopper 100 with an alternative bristle arrangement. Particularly, the bristle rows 28 shown in the example comprise large bristles with large heads but a fewer number of bristles per row than the previously shown and described bristle rows. Further shown is an alternative cap 114 attached to stem 102. Cap 114, like the previously shown and described caps 19, 30, may include a threaded aperture 34 for removable attachment of the cap to the threaded stud 32 and includes a circumferential groove 36 for receiving and retaining the seal 20. Additionally, the upper end of the cap has an enlarged circular-shaped plate element 116.

Figure 12:
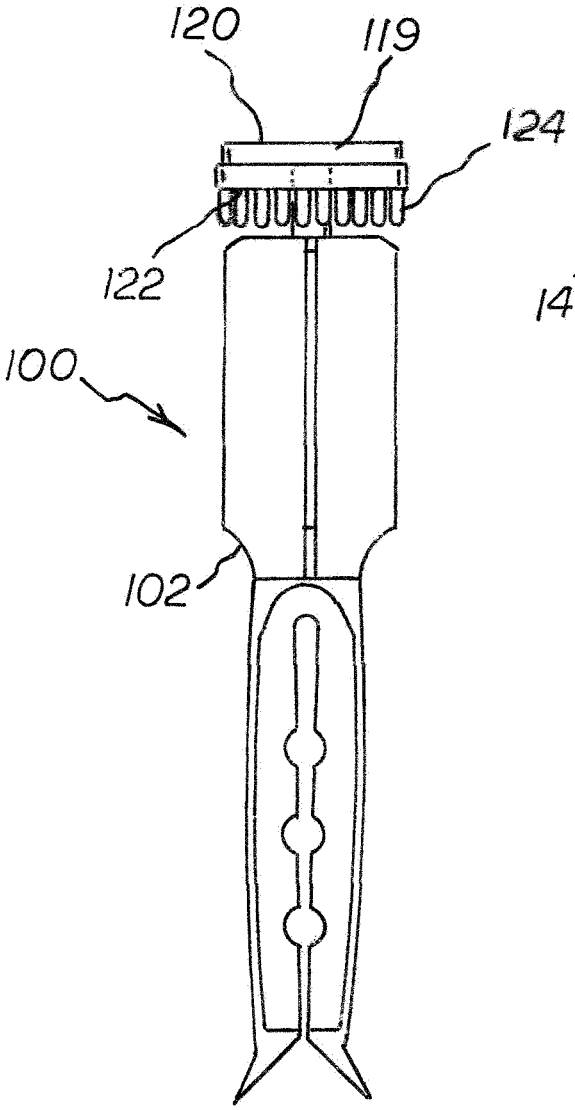
FIG. 12 is a side elevation view of popup drain stopper provided in accordance with an embodiment of the invention.
Figure 13:
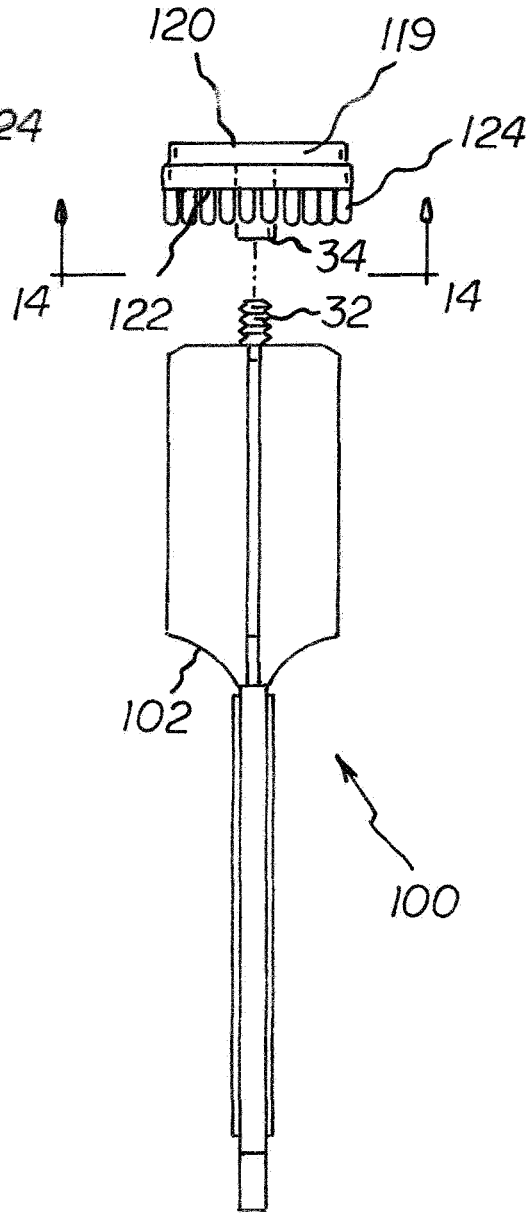
FIG. 13 is a second side elevation view of the popup drain stopper of FIG. 12, shown partially exploded.
Figure 14:
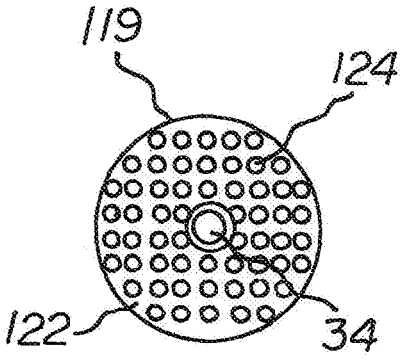
FIG. 14 is a bottom view of a cap provided in accordance with an embodiment of the invention.

FIGS. 12 and 13 illustrate stopper 100 without bristle rows 28 located on the stem 102 and with an alternative cap 118. Cap 119, like the previously described caps, may include a threaded aperture 34 for removably attachment to the threaded stud 32. With further reference to FIG. 14, cap 119 has a generally circular shaped body with a top side 120 and an opposite bottom side 122. Extending outwardly from the bottom side are a plurality of bristles 124. When the cap 119 is attached to the stem 102, the bristles 124 extend in a direction toward the bottom end of the stem and are arranged around the top of the stem. Like bristle rows 28, bristles 124 provide a debris trap for trapping, collecting, or otherwise entangling debris that flows through the drain opening 14. The debris being trapped by the bristles 124 is prevented from flowing through the drainpipe, thereby preventing clogging thereof.

Figure 15:
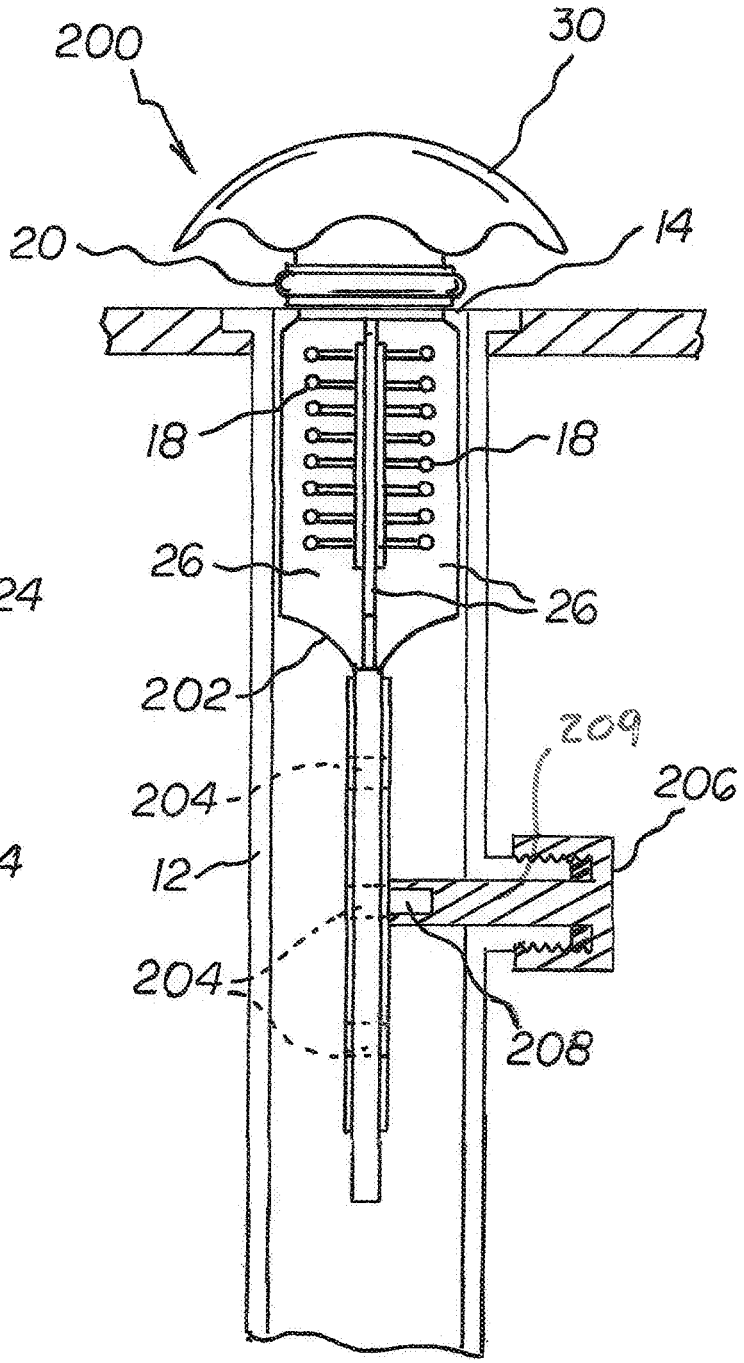
FIG. 15 is a first side elevation view, partially in cross-section, showing a popup drain stopper provided in accordance with an embodiment of the invention in a drainpipe.

FIGS. 15-17 illustrate a popup drain stopper 200 in accordance with an embodiment of the invention. Stopper 200 has a construction like stoppers 10, 100 and, accordingly, like reference numbers refer to similar elements. Stopper 200 is configured to allow for easier insertion and removal from the drainpipe 12 and is operatable without a stopper operating mechanism having a lever rod.

Particularly, as shown, a lower length of stem 202 of stopper 200 is generally planar shaped and has opposing broad flat faces providing at least one broad flat face that is configured to slide across a retaining magnet. A series of magnets 204 are spaced along the stem. The magnets 204 are configured to engage with a plug 206 that is attached to the drainpipe 24 and extends into the flow passage thereof. The plug 206 can have a ferrous material 208 to which the magnets 204 are magnetically attracted. Alternatively, the material 208 could be a retaining magnet that is arranged with its magnetic poles opposite of magnets 204 to cause an attractive, magnetic force therebetween. Also, the magnets 204 could be replaced with a ferrous material that is magnetically attracted to a magnet in the plug 206. The plug 206 has a fixed projection 209 that extends into the drainpipe 12 and the material or magnet 208 is disposed at the end of the fixed projection.

In operation, the position of the stopper 200 in the drainpipe 24 is selectively adjusted by simply pulling up or pushing down on the stopper. The stopper 200 will be held in selective positions by the magnetic force between one of the magnets 204 and the material/magnet 208. Additionally, the stopper 200 can be completely removed from the drainpipe 12 by simply pulling it upward and out of the drain opening 14.

Stopper 200 is further shown with cap 30 and bristle rows 18 located on opposite sides of at least two fins 26. Additionally, plug 206 can be configured to attach to the drainpipe 12 where the typical or conventional stopper operating mechanism, including the lever rod, is attached to the drainpipe.

Figure 20:
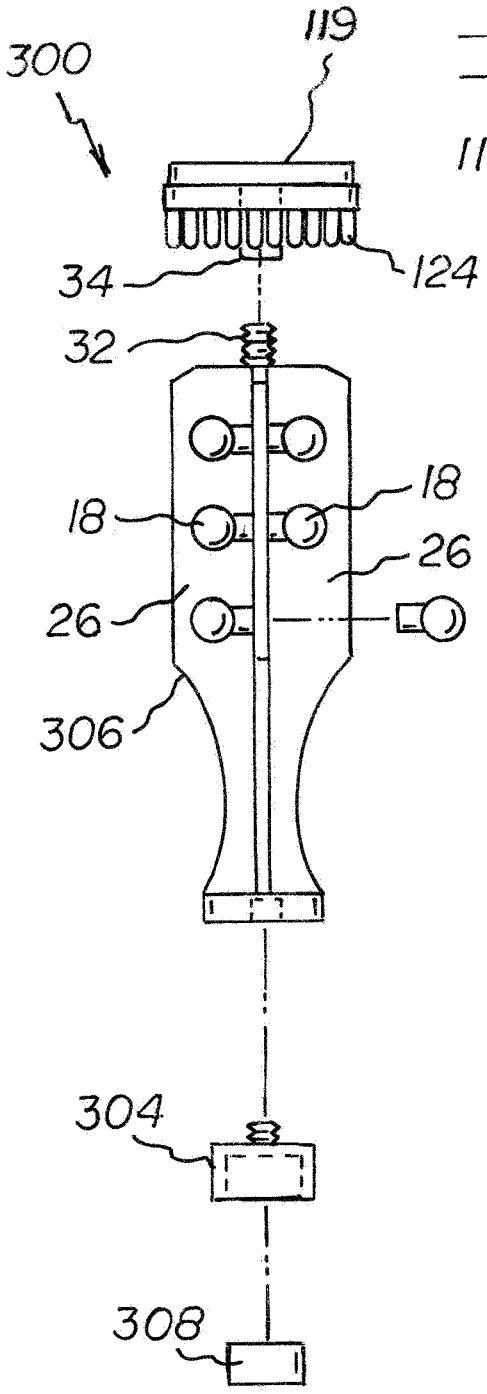
FIG. 20 is a side elevation view of the popup drain stopper of FIG. 19, shown partially exploded.
Figure 19:
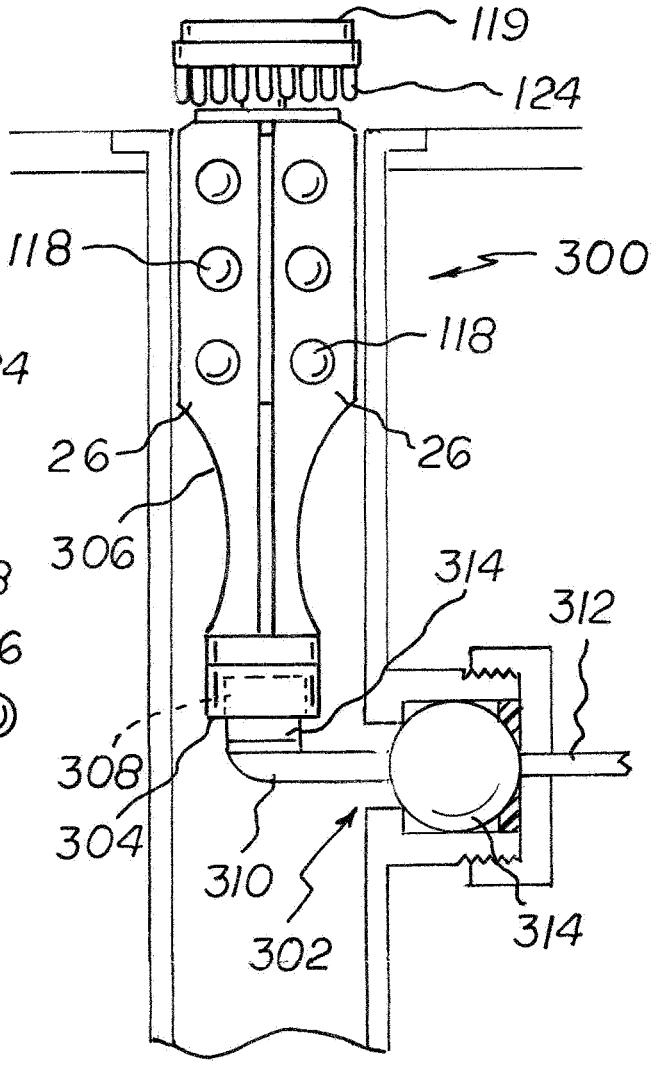
FIG. 19 is a first side elevation view, partially in cross-section, showing a popup drain stopper provided in accordance with an embodiment of the invention in a drainpipe.

FIGS. 19 and 20 illustrated a popup drain stopper 300 and operating mechanism 302 in accordance with an embodiment of the invention. Stopper 300 has a construction like stopper 10, 100, and 200 and, accordingly, like reference numbers refer to similar elements. Stopper 300 and operating mechanism 302 are configured to allow an easier coupling and decoupling without requiring a user to dissemble the operating mechanism. Further, the stopper 300 and operating mechanism 302 are configured to prevent an unknowledgeable user from inadvertently breaking the stopper or the lift mechanism when he or she attempts to forcefully withdraw the stopper from an associated drainpipe.

Particularly, as shown, the bottom 304 of the stopper stem 306 has a magnet 308 attached therewith. The bottom 304, together with the magnet 308, are configured to removably engage with an end 310 of a lever rod 312. The lever rod end 310 has a magnet or ferrous material 314 that is magnetically attracted to the magnet 308 on the stopper stem 306. According, the magnet 308 and magnet or ferrous material 314 provide a magnetic coupling between the stopper stem 306 and the lever rod 312. The magnet 308 could be exchanged with a ferrous material that would be magnetically attracted to the magnet 314 on the lever rod end 310.

Conventionally, lever rod 312 has a ball 314 that is captively held in a socket and that allows the rod to be moved upward and downward by a connecting rod that extends upwardly, such configuration is well known in the field. Stopper 300 is further shown with cap 119 and bristle rows 18 having the large head configuration located on opposite sides of at least two fins 26.

Many different embodiments and configurations have been disclosed in connection with the above description and the drawings. It is important to note that aspects from one embodiment may be used with other embodiments. For example, the foregoing description describes many different cap configurations and many different stopper configurations. It shall be understood that any one cap configuration can be used with any one stopper configuration. Similarly, many different bristle configurations are described herein. It shall be understood that any bristle configuration could be used in connection with any stopper configuration.

An equivalent substitution of two or more elements can be made for any one of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a sub-combination or variation of a sub-combination.

It will be appreciated by persons skilled in the art that the present embodiment is not limited to what has been particularly shown and described hereinabove. A variety of modifications and variations are possible in light of the above teachings without departing from the following claims.

What is claimed is:

1. A popup drain stopper comprising:

a stem configured to be movable vertically within a drainpipe, the stem having a top end, a bottom end, a length extending therebetween, and at least two fins extending along the length;

a cap attached to the top end of the stem;

a plurality of bristles attached to and extending outwardly from at least one fin and configured to trap debris entering the drainpipe when the stem is disposed in the drainpipe;

wherein a lower length of the stem is bifurcated into a pair of coextending tangs that are separated by a slot that extends from the bottom end of the stem in a direction toward the upper end of the stem, each tang has an outward side surface;

the slot being configured to removably receive a lever rod in a sliding engagement between the tangs in a direction upwardly from the bottom end of the stem;

a lower end of each tang has a winglet, the winglets providing a fishtail-shaped notch therebetween at the bottom end of the stem, the fish-shaped notch narrows in a direction from the bottom end of the stopper toward the top end of the stopper, the winglets combined with the fishtail-shaped notch guide the lever rod toward the open end of the slot when the lever rod is slid into engagement with the slot; and wherein the winglets each have an outward surface that extend in opposite directions of one another, and the winglets each have a winglet tip that terminates at a position beyond the outward side surface of the respective tang.

2. The popup drain stopper of claim 1, wherein the plurality of bristles are attached to opposite broad surfaces of at least one fin.

3. The popup drain stopper of claim 1, wherein the plurality of bristles are arranged in rows.

4. The popup drain stopper of claim 1, wherein at least two fins intersect and form a corner that extends along the stem, and wherein the plurality of bristles are arranged in rows and at least one row of bristles extends in the corner along the stem.

5. The popup drain stopper of claim 1, wherein the cap is removable from the stem.

6. The popup drain stopper of claim 1, wherein the cap is dome shaped.

7. The popup drain stopper of claim 1, wherein the cap is disk shaped.

8. The popup drain stopper of claim 1, wherein the cap has a bottom end having a plurality of cap bristles extending outwardly therefrom and generally in direction toward the bottom end of the stem.

9. A popup drain stopper assembly, comprising:

a stem configured to be movable vertically within a drainpipe, the stem having a top end, a bottom end, a length extending therebetween, and at least two fins extending along the length;

a cap attached to the top end of the stem;

a plurality of bristles attached to and extending outwardly from at least one fin and configured to trap debris entering the drainpipe when the stem is disposed in the drainpipe;

a lower end of the stem having a plurality of stem magnets spaced along a length of the lower end;

a fixed projection extending into the drainpipe from a sidewall of the drainpipe and terminating at and end;

a retaining magnet disposed on the end of the fixed projection and configured to selectivity retain the stem at a desired position in the drainpipe by a magnetic force between a stem magnet and the retaining magnet;

wherein the length of the lower end of the stem having the plurality of spaced magnets is planar-shaped providing at least one broad flat face that is configured to slide across the retaining magnet; and wherein a drain opening of the drainpipe is opened by a user grasping the cap and pulling stem upwardly in the drainpipe to magnetically engage the retaining magnet with one stem magnet that is at a first position along the stem and the drain opening is closed by the user pushing down on the cap and moving the stem downwardly in the drainpipe to magnetically engage the retaining magnet with a second stem magnet that is at a second position along the stem, the second position being closer to the top end of the stem than the first position.

10. The popup drain stopper assembly of claim 9, wherein the plurality of bristles are attached to opposite broad surfaces of at least one fin.

11. The popup drain stopper assembly of 9, wherein the plurality of bristles are arranged in rows.

12. The popup drain stopper assembly of claim 9, the planar-shaped lower end provides two opposed broad flat faces that are configured to slide across the retaining magnet.

13. The popup drain stopper assembly of claim 12, wherein at least one of the a plurality of stem magnets extends between the two opposed broad flat faces.

14. The popup drain stopper assembly of claim 12, wherein each of the a plurality of stem magnets extends between the two opposed broad flat faces.

* * * * *